US006457184B1

(12) United States Patent
Adams

(10) Patent No.: US 6,457,184 B1
(45) Date of Patent: Oct. 1, 2002

(54) HAT WITH GOLF BALL MARKING DEVICE

(75) Inventor: Kevin Adams, Westerly, RI (US)

(73) Assignee: B & M Associates, Inc. of Destin, Santa Rosa Beach, FL (US)

( * ) Notice: Subject to any disclaimer, the term of this patent is extended or adjusted under 35 U.S.C. 154(b) by 0 days.

(21) Appl. No.: 09/829,660

(22) Filed: Apr. 10, 2001

(51) Int. Cl.[7] ..... A42B 1/24
(52) U.S. Cl. ..... 2/209.13; 2/195.1; 224/918
(58) Field of Search ..... 2/175.1, 195.1, 2/195.2–195.4, 209.13; 224/918

(56) References Cited

U.S. PATENT DOCUMENTS 3,895,797 A * 7/1975 Moore ..... 273/32
4,815,148 A * 3/1989 Satterfield ..... 2/197
5,509,144 A * 4/1996 Soergel et al. ..... 2/195.1
5,509,145 A * 4/1996 Stevenson et al. ..... 2/195.1
5,740,557 A * 4/1998 Reid et al. ..... 2/209.13
5,860,167 A * 1/1999 Lizio ..... 2/209.13
5,898,946 A * 5/1999 Keating et al. ..... 2/209.13
6,163,889 A * 12/2000 Tate ..... 2/209.13
6,175,963 B1 * 1/2001 Loeffelholz ..... 2/204.13

* cited by examiner

*Primary Examiner*—John J. Calvert
*Assistant Examiner*—Katherine Moran
(74) *Attorney, Agent, or Firm*—Larson & Larson, PA; James E. Larson

(57) ABSTRACT

A combination hat and golf ball marking device is provided. The hat includes a generally round convex-shaped body portion for placing over the a skull of a golfer. A bill member extends from a front side of the body portion and works to shade the face of the golfer. A removable golf ball marker is received and retained by a receptacle located at a crown portion of the hat body portion. The marker has a head member and a post for inserting within the ground of a putting green when a golfer has removed his golf ball therefrom. The post inserts into a bore in the receptacle when the marker is not being used.

14 Claims, 7 Drawing Sheets

HAT WITH GOLF BALL MARKING DEVICE

BACKGROUND OF THE INVENTION

1. Field of the Invention

This invention relates to hats. More particularly, it relates to a hat used by golfers. Even more particularly, it relates to a golfer's hat incorporating a golf ball marking device.

2. Description of Prior Art

In the game of golf it is courteous to pick up your golf ball from the putting green after you have successfully reached the putting green, but before everyone begins to putt their ball towards the hole. This removes distractions that your ball may cause to another golfer who may be putting before you, since the golfer furthest from the hole putts first. This is especially true if your ball is within someone's "lie" or in the same plane or line of sight to the hole. Since golf is a "game of inches", it is imperative that the person who picks up their golf ball, place the ball back in the exact location from which it was removed. This is especially important in tournament or professional competition which requires exact replacement of the golf ball.

It was therefore contemplated that a marking device was needed for indicating the exact position of the golf ball that was picked up from the putting green. In amateur play, many people simply use coins, such as, for example, a dime or penny. Unfortunately, this is not ideal, since the coin does not penetrate the green but instead rests above the ground surface. If someone then putts a golf ball and it rolls over the coin, it could cause the ball to change direction thereby effecting the person's putt. This type of marking device is therefore deficient and ineffective.

To fulfill a need for a golf ball marking device, small pin like devices where developed which could be used to mark the position of the golf ball on the putting green. The device resembles a tack having a flat head portion with a rod portion extending downwardly at a perpendicular angle for insertion into the ground surface of the putting green. Although the device proved to be useful, it was very common to misplace the marking device due to its very small size. Golfer's therefore were constantly purchasing new marking devices after losing the one currently in their possession.

Improvements where made to the golf ball marking device which permitted the golfer to conveniently store the marker in a location for ease of use and accessibility. One such example is on a golf glove. On the glove, a tack-like marker attaches to a lower edge of the golf glove proximal to the golfer's wrist. Unfortunately, these markers also seem to be misplaced easily. It should actually be said that these devices are easily lost, since they tend to fall off the glove due to the golfer constantly swinging the golf club and striking the ball and ground. The force of the club striking the ball and ground causes the marker to become dislodged from its receptacle and fall to the ground by gravity. And usually, the golfer is not aware that the marker has fallen off the glove until it is to late. It is only upon reaching the putting green that the golfer realizes that the marker has been lost. Of course by this time, there is essentially no chance of finding or retrieving the marker. An improved golf ball marker is clearly needed to overcome these deficiencies seen in the prior art.

SUMMARY OF THE INVENTION

I have invented an improved golf ball marking device which is incorporated into a baseball style cap. In particular, my marker attaches to a crown portion of the cap and is removable by the user when needed. And, when it is no longer needed, the marker can be easily and safely reattached to the cap so that it is not lost.

The marker includes a head portion resembling a button used on baseball style caps. The head portion acts as the golf ball marker when employed on the putting green. A small receptacle is disposed upon the cap crown portion for receiving and retaining the marker. A small downwardly extending post snaps into the receptacle. The post also acts as an anchor when the marker is inserted into the ground of the putting green.

After use of the golf ball marker, it can be easily reapplied to the cap of the golfer. Continued swinging of the golf club and the resulting striking of the golf ball and ground does not operate to dislodge the marker as in the deficient prior art devices. This is because the force of the swing striking the ball or ground is translated mostly through the hands and arms of the person swinging the golf club. only a very small amount of the force of the swing translates all the way up to the head of the golfer, and typically this is not enough force to dislodge the marker. Further, even if the marker was to become dislodged, there is a high probability that the golfer would notice that the marker has become dislodged and is rolling off his head, resulting in a higher probability of finding the golf ball marking device on the ground.

BRIEF DESCRIPTION OF THE DRAWINGS

The invention may be best understood by those having ordinary skill in the art by reference to the following detailed description when considered in conjunction with the accompanying drawings in which.

DETAILED DESCRIPTION OF THE INVENTION

Figure 1:
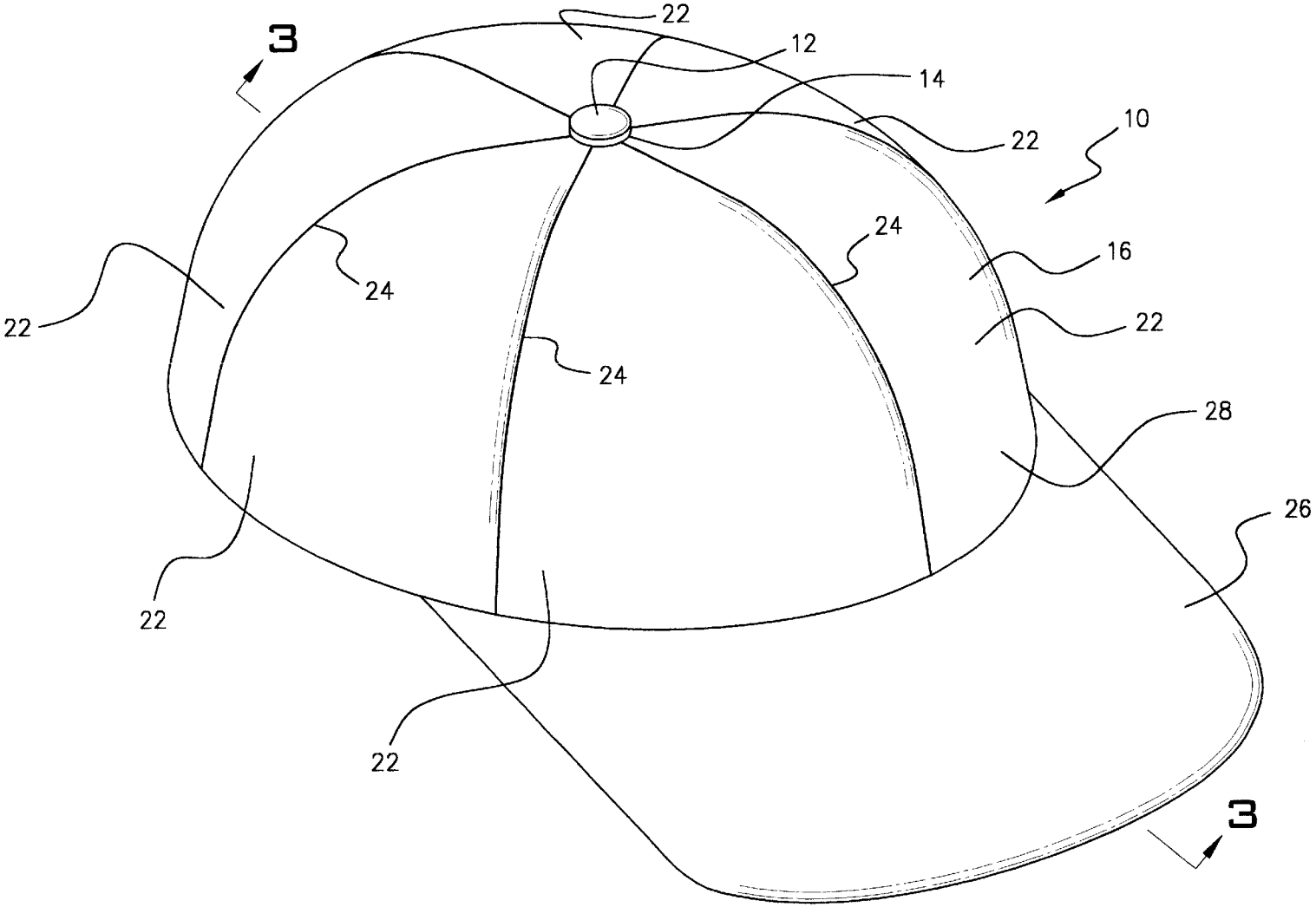
FIG. 1 is a perspective view of a hat of the present invention having a golf ball marking device.

Throughout the following detailed description, the same reference numerals refer to the same elements in all figures.

Referring to FIG. 1, a cap 10 is shown having a removable golf ball marker 12 disposed upon a crown portion 14. Cap 10 has a generally circular body portion 16 for inserting over a head (not shown) of a person. Cap body portion 16 can conform to many different person head sizes by adjusting a strap 18 (see FIGS. 3 and 4) located along a back side 20 of cap body portion 16.

Figure 2:
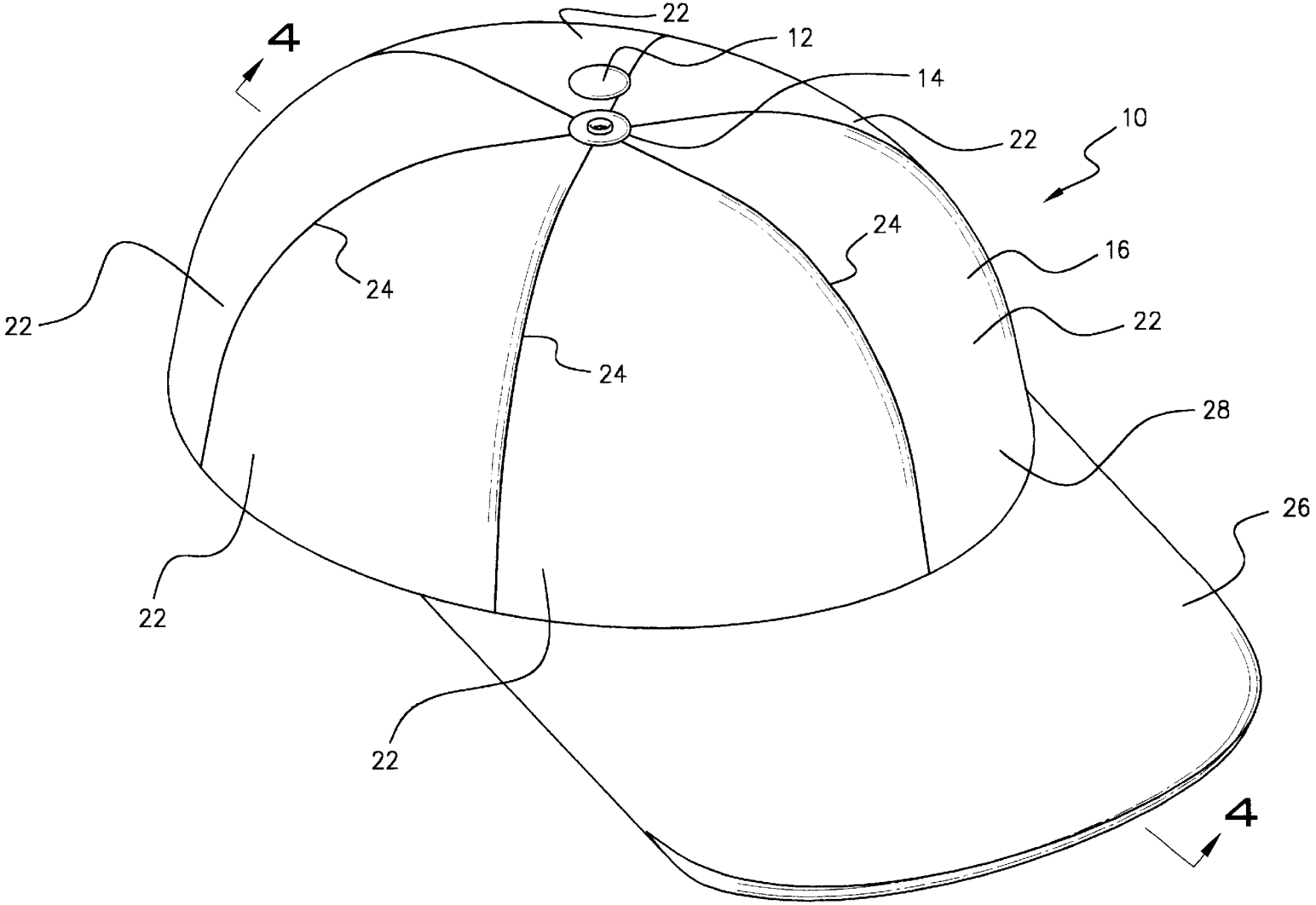
FIG. 2 is a perspective view of the hat of the present invention illustrating how the golf ball marking device snaps into a receiving member upon a crown portion of the hat.

With reference to FIGS. 1 and 2, it is shown that cap body portion 16 is formed by attaching a plurality of panels 22 to one another. In the preferred embodiment, six panels 22 are employed and held together by stitching 24. However, nothing herein limits the number of panels 22 that can be used and different methods of attachment can be employed, such as, for example, glue or heat seal bonding. As to the preferred embodiment depicted in FIGS. 1 and 2, it is shown that all six panels 22 meet at crown portion 14. Cap 10 also includes a bill portion 26 extending from a front side 28 of cap body portion 16. Bill portion 26 acts to shade the face (not shown) of the person wearing cap 10.

Figure 3:
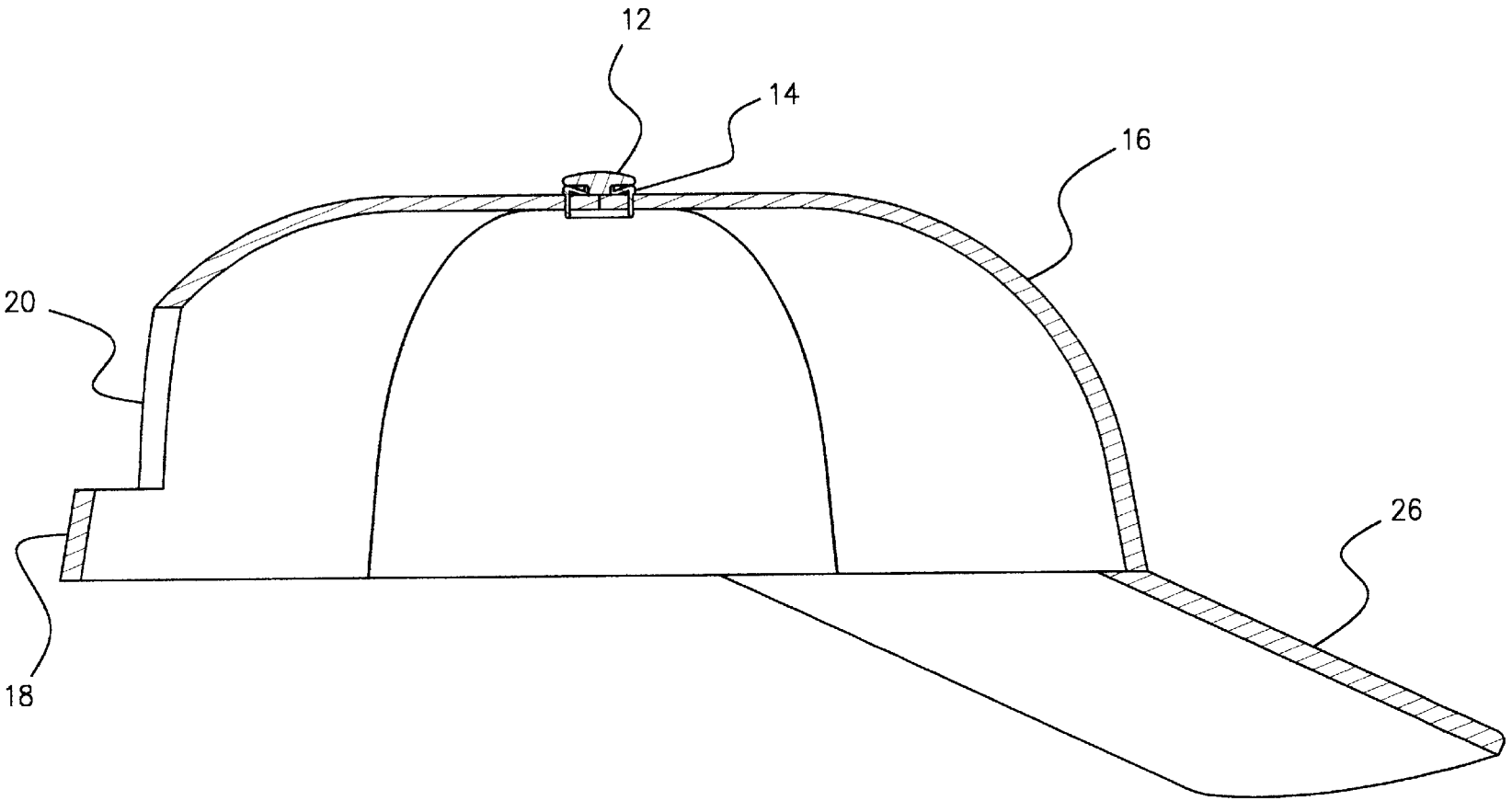
FIG. 3 is a cross-sectional view along lines 3—3 of FIG. 1.
Figure 4:
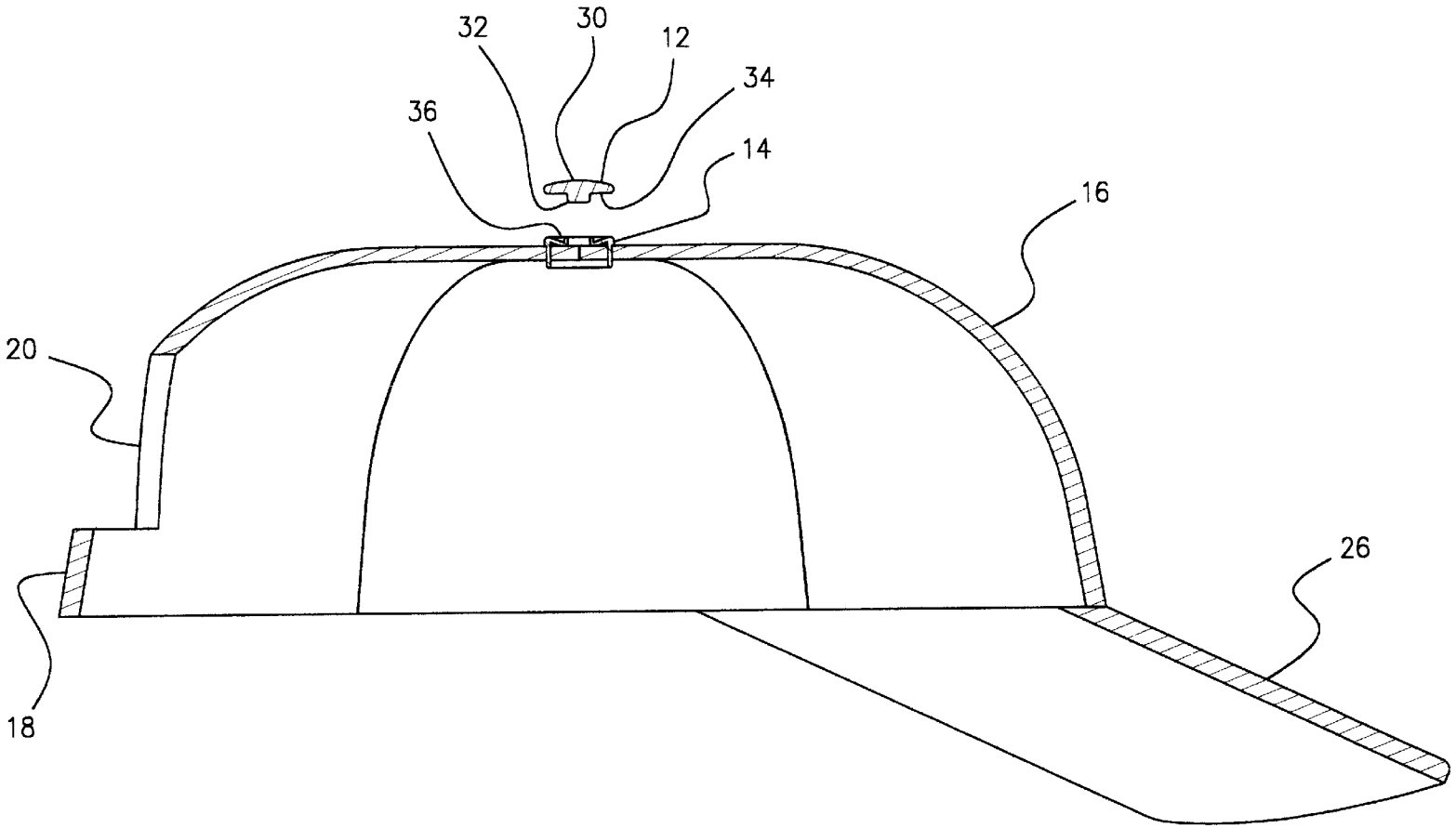
FIG. 4 is a cross-sectional view along lines 4—4 of FIG. 2.
Figure 6:
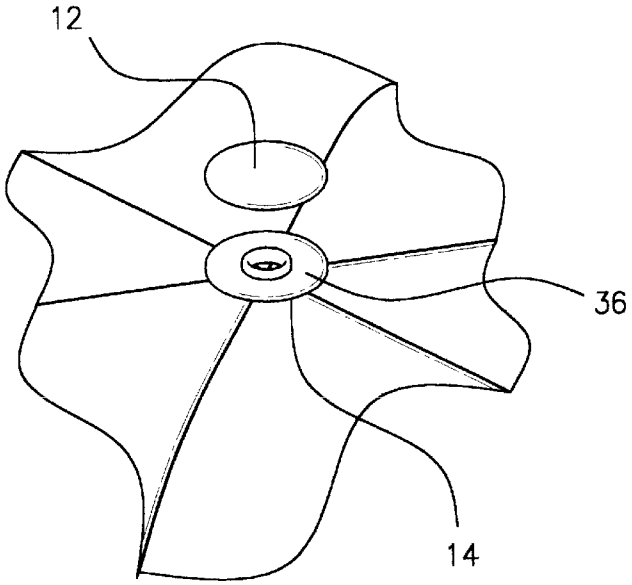
FIG. 6 is a partial detail of FIG. 2 illustrating how the golf ball marking device snaps into the receiving member upon the crown portion of the hat of the present invention.

As shown in FIGS. 3 and 4, removable marker 12 can be removed and reattached to cap crown portion 14. Referring to FIG. 4, marker 12 includes a slightly convex-shaped head portion 30 and a downwardly extending post 32 disposed perpendicularly to marker head portion 30. In the preferred embodiment, post 32 is integrally attached to a bottom side 34 of head portion 30. A receptacle 36 is mounted in cap crown portion 14 and works to receive and retain marker post 32 by friction. Marker head portion 30 is generally circular as is receptacle 36.

Figure 8:
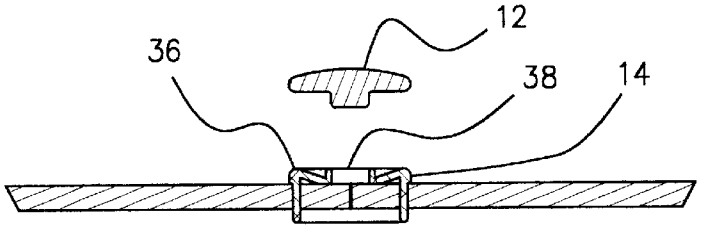
FIG. 8 is a partial detail of FIG. 4.
Figure 5:
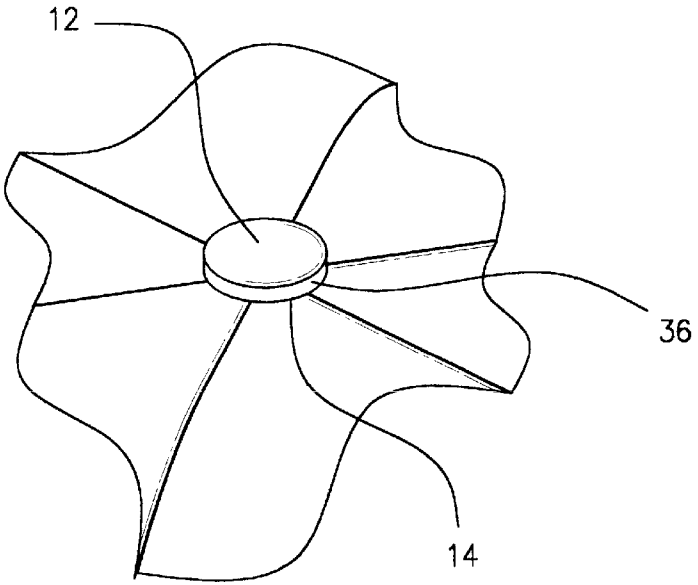
FIG. 5 is a partial detail of FIG. 1 illustrating how the golf ball marking device attaches to the crown portion of the hat of the present invention.
Figure 7:
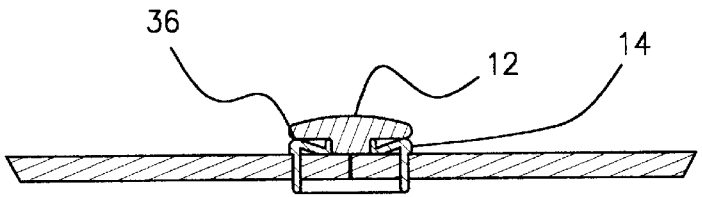
FIG. 7 is a partial detail of FIG. 3.

Referring to FIGS. 7 and 8, it is shown that receptacle 36 is mounted in cap crown portion 14. Receptacle 36 includes a small circular bore 38 which has an inner circumference that is slightly smaller than an outer circumference of post 32 which operates to provide a friction fit between marker 12 and receptacle 36. Accordingly, when needed, a golfer simply places a fingernail underneath marker head portion 30 and applies a small amount of force which "pops" marker 12 from out of receptacle 36. Marker 12 can now be used on the putting green to mark the location of a golf ball removed therefrom. After replacing the golf ball back onto the putting green, marker 12 can be put away. To reapply marker 12 to cap 10, the golfer axially aligns marker post 32 with receptacle bore 38 and applies a small amount of downwardly exerted force towards cap crown portion 14 with a finger (i.e., the thumb) thereby "snapping" marker 12 back into receptacle 36.

Figure 9:
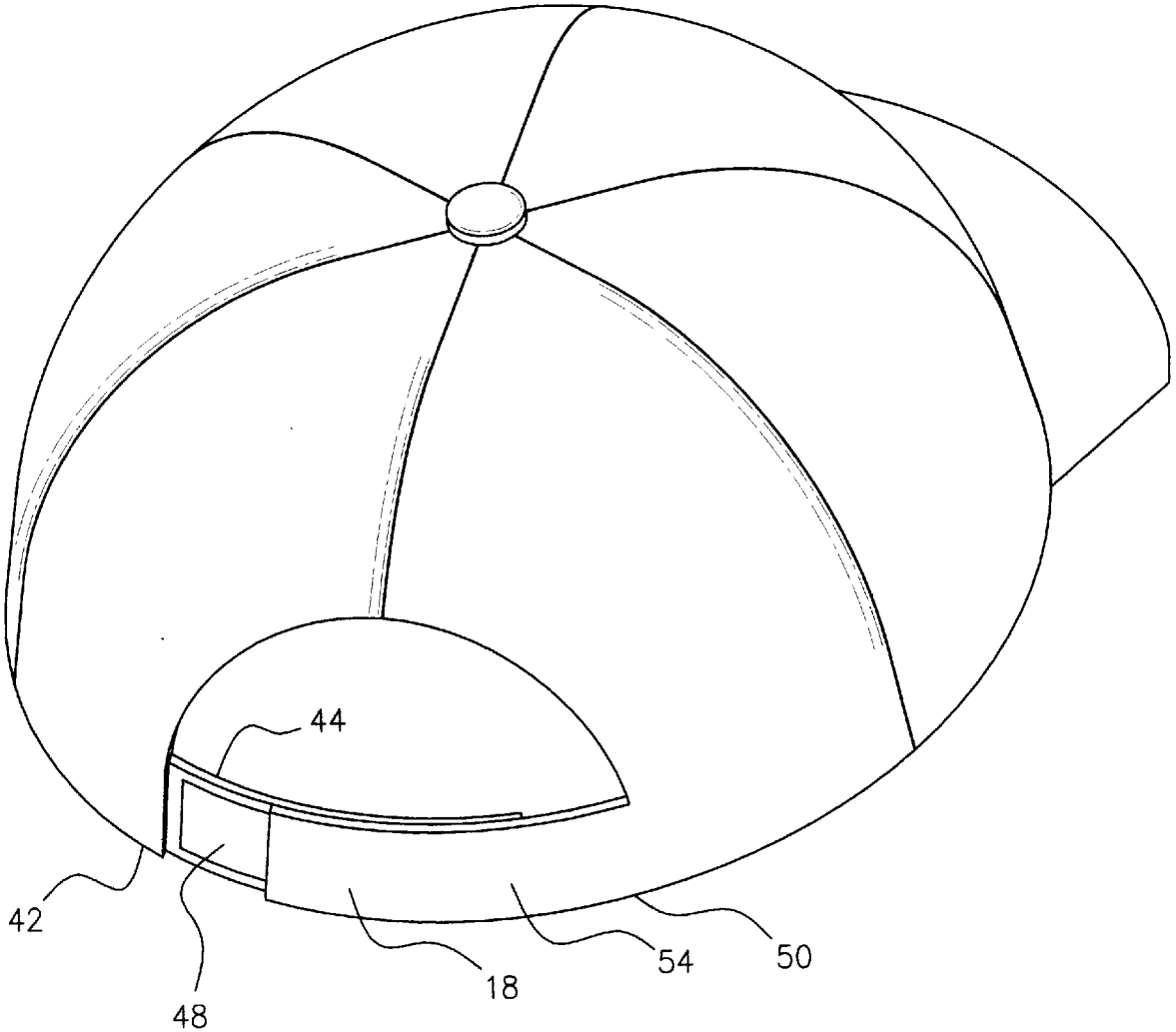
FIG. 9 is a rear detail of the hat showing the straps attached.
Figure 10:
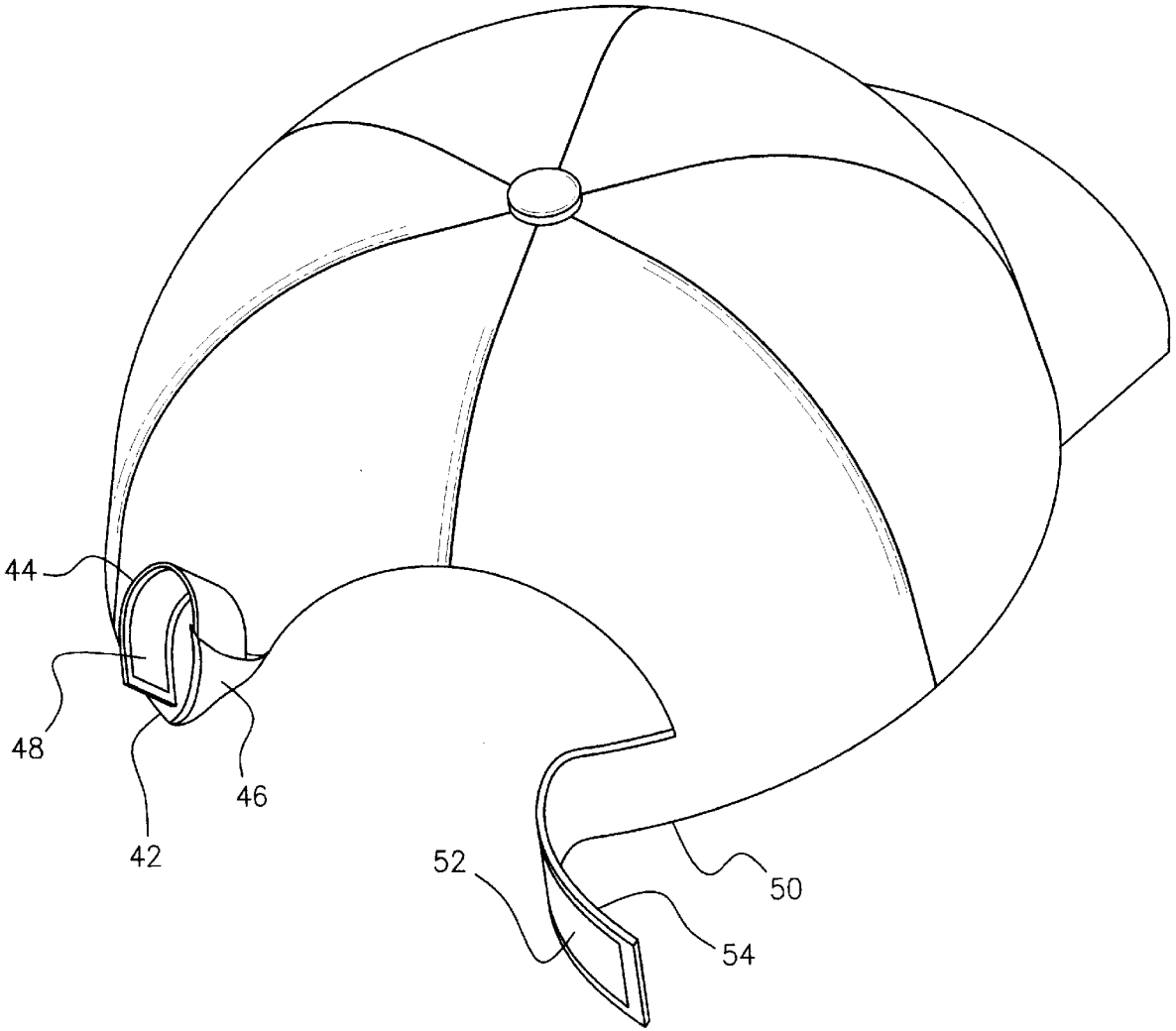
FIG. 10 is a rear detail of the hat showing the strap parts in an open configuration.

FIGS. 9 and 10 show the adjustable strap 18. Such strap has a first strip 44 of material attached to an inner surface 46 of the body portion along the lower edge 42 at a first end, the first strip of material 44 having a strip of loop material 48 disposed along an opposed second end, the loop material 48 engaging the complimentary hook material 52 on a second strip 54 attached to an inner surface of the lower edge 50 distal from the first strip 44 of material.

In a first alternate embodiment, marker 12 and receptacle 36 are magnetized such that marker 12 is retained by receptacle 36 by a magnetic force attraction. In a second alternate embodiment, marker post 32 is threaded (not shown) and screws into receptacle bore 38 which is formed to receive the threaded marker post.

Equivalent elements can be substituted for the ones set forth above such that they perform the same function in the same way for achieving the same result.

Having thus described the invention what is claimed and desired to be secured by Letters Patent is:

1. A combination hat and golf ball marking device comprising:

a) a convex-shaped generally round body portion having a front and back side and a crown portion, the body portion or laying upon a skull of a golfer and made of at least one sheet of fabric;

b) a generally flat bill member extending outwardly from the body portion front side at an angle that is generally parallel to a ground surface when the hat is worn by the golfer, the bill member for shading a face of the golfer;

c) a receptacle member mounted on the body portion at the crown portion, the receptacle member having a circular bore formed at a middle portion thereof, the circular bore being located at the center of the crown portion and having an axis which is perpendicular to the ground surface when the hat is worn by the golfer;

d) a removable golf ball marking device having a generally flat head member and a downwardly extending post located along a bottom side of the marker head member, the post disposed at a perpendicular angle from the head member and axially aligning with the receptacle bore axis when the marking device is applied to the hat; and e) the marking device post having an outer circumference slightly larger than an inner circumference of the receptacle bore so that the post snaps into the receptacle bore and is held in the receptacle bore by friction.

2. The combination hat and golf ball marking device of claim 1, wherein a plurality of individual panels are employed for the body portion at least one sheet of fabric, each panel attached along opposed side edges to an adjacent panel.

3. The combination hat and golf ball marking device of claim 2, wherein six panels are employed.

4. The combination hat and golf ball marking device of claim 1, wherein the panels are attached by stitching.

5. The combination hat and golf ball marking device of claim 1, further comprising the receptacle member having a circular flange surrounding the circular bore.

6. The combination hat and golf ball marking device of claim 1, further comprising an adjustable strap located along a lower edge of the body portion back side.

7. The combination hat and golf ball marking device of claim 6, wherein the adjustable strap comprises a first strip of material attached to an inner surface of the body portion along the lower edge at a first end, the first strip of material having a strip of loop material disposed along an opposed second end, the strap further comprising a second strip of material attached to an inner surface of the body portion along the lower edge at a first end, the second strip material having a strip of complimentary hook material disposed along an opposed second end for releasably securing the opposed second end of the strap.

8. The combination hat and golf ball marking device of claim 1, wherein the marking device post is integrally attached to the flat head member.

9. A combination hat and golf ball marking device comprising:

a) a convex-shaped generally round body portion having a front and back side and a crown portion, the body portion for placing over a skull of a golfer, the body portion having a plurality of panels attached to one another along side edges by stitching;

b) a generally flat bill member extending outwardly from the body portion front side at an angle that is generally parallel to a ground surface when the hat is worn by the golfer, the bill member having a curved outer edge and capable of shading a face of the golfer;

c) a receptacle member mounted on the body portion at the crown portion, the receptacle member having a circular bore formed at a middle portion thereof, the circular bore being located at the center of the crown portion and having an axis which is perpendicular to the ground surface when the hat is worn by the golfer;

d) a removable golf ball marking device having a generally flat head member and a downwardly extending post located along a bottom side of the marker head member, the post disposed at a perpendicular angle from the head member and axially aligning with the receptacle bore axis when the marking device is applied to the hat; and e) the marking device post having an outer circumference slightly larger than an inner circumference of the receptacle bore so that the post snaps into the receptacle bore and is held in the receptacle bore by friction.

10. The combination hat and golf ball marking device of claim 9, wherein six panels are employed.

11. The combination hat and golf ball marking device of claim 9, further comprising the receptacle member having a circular flange surrounding the circular bore.

12. The combination hat and golf ball marking device of claim 9, further comprising an adjustable strap located along a lower edge of the body portion back side.

13. The combination hat and golf ball marking device of claim 12, wherein the adjustable strap comprises a first strip of material attached to an inner surface of the body portion along the lower edge at a first end, the first strip of material having a strip of loop material disposed along an opposed second end, the strap further comprising a second strip of material attached to an inner surface of the body portion along the lower edge at a first end, the second strip material having a strip of complimentary hook material disposed along an opposed second end for releasably securing the opposed second end of the strap.

14. The combination hat and golf ball marking device of claim 9, wherein the marking device post is integrally attached to the flat head member.

* * * * *